US010792670B2

(12) United States Patent
Müller-Siebert et al.

(10) Patent No.: US 10,792,670 B2
(45) Date of Patent: Oct. 6, 2020

(54) METHOD AND DEVICE FOR FRAGMENTING AND/OR WEAKENING POURABLE MATERIAL BY MEANS OF HIGH-VOLTAGE DISCHARGE

(71) Applicant: selFrag AG, Kerzers (CH)

(72) Inventors: Reinhard Müller-Siebert, Bern (CH); Joel Kolly, Corminboeuf (CH)

(73) Assignee: selFrag AG, Kerzers (CH)

( * ) Notice: Subject to any disclaimer, the term of this patent is extended or adjusted under 35 U.S.C. 154(b) by 382 days.

(21) Appl. No.: 15/553,692

(22) PCT Filed: Feb. 27, 2015

(86) PCT No.: PCT/CH2015/000032
§ 371 (c)(1),
(2) Date: Aug. 25, 2017

(87) PCT Pub. No.: WO2016/134490
PCT Pub. Date: Sep. 1, 2016

(65) Prior Publication Data
US 2018/0043368 A1 Feb. 15, 2018

(51) Int. Cl.
*B02C 19/18* (2006.01)
*B02C 23/12* (2006.01)
*B02C 23/36* (2006.01)

(52) U.S. Cl.
CPC ..... *B02C 19/18* (2013.01); *B02C 23/12* (2013.01); *B02C 23/36* (2013.01); *B02C 2019/183* (2013.01)

(58) Field of Classification Search
CPC ..... B02C 19/18; B02C 19/183; B02C 23/12; B02C 23/36
See application file for complete search history.

(56) References Cited

U.S. PATENT DOCUMENTS 3,208,674 A * 9/1965 Bailey ..... B02C 19/18 241/1
4,182,216 A 1/1980 DeCaro
(Continued)

FOREIGN PATENT DOCUMENTS

BE 864969 A2 7/1978
DE 19545580 A1 6/1997
(Continued)

OTHER PUBLICATIONS

Hoshikawa, Translation JP-2003284966-A (Year: 2003).*
(Continued)

*Primary Examiner* — Adam J Eiseman
*Assistant Examiner* — Bobby Yeonjin Kim
(74) *Attorney, Agent, or Firm* — Marshall, Gerstein & Borun LLP

(57) ABSTRACT

A method for fragmenting and/or weakening of pourable material by means of high-voltage discharges is disclosed. Thereby, a material flow of the pourable material is, immersed in a process liquid, guided past a high-voltage electrode assembly with one or more high-voltage electrodes, while high-voltage punctures through the material are produced by means of charging of the high-voltage electrodes with high-voltage pulses. The zone of the material flow in which the high-voltage punctures through the material are produced is delimited laterally by substantially unmoved zones of the same material as viewed in a guiding-past direction. With the disclosed method, it becomes possible to fragment and/or weaken pourable material in a continuous process by means of high-voltage punctures in a low-wear and low-contamination manner.

9 Claims, 9 Drawing Sheets

(56) References Cited

U.S. PATENT DOCUMENTS

| | | | |
|---|---|---|---|
| 2005/0180841 | A1 | 8/2005 | Cao |
| 2014/0130335 | A1 | 5/2014 | Bickford et al. |

FOREIGN PATENT DOCUMENTS

| | | | | | |
|---|---|---|---|---|---|
| DE | 19727534 | A1 | | 1/1999 | |
| DE | 197 36 027 | A1 | | 3/1999 | |
| DE | 19902010 | A1 | | 8/2000 | |
| DE | 69913493 | T2 | | 5/2004 | |
| FR | 982415 | A | | 6/1951 | |
| FR | 2302441 | A1 | | 9/1976 | |
| GB | 854830 | A | | 11/1960 | |
| JP | H09192526 | A | | 7/1997 | |
| JP | 2003154286 | A | * | 5/2003 | |
| JP | 2003284966 | A | * | 10/2003 | ..... B02C 2019/183 |
| KR | 20120139638 | A | | 12/2012 | |
| RU | 2263545 | C1 | | 11/2005 | |
| RU | 113177 | U1 | | 2/2012 | |
| RU | 2667750 | C1 | | 9/2018 | |
| RU | 2670126 | C1 | | 10/2018 | |
| SU | 1178487 | A1 | | 9/1985 | |
| SU | 1538928 | A1 | | 1/1990 | |
| SU | 888355 | A1 | | 11/1991 | |
| WO | WO-1999003588 | A1 | | 1/1999 | |
| WO | WO-2013053066 | A1 | | 4/2013 | |

OTHER PUBLICATIONS

Hoshikawa, Translation of JP-2003154286-A (Year: 2003).*

International Search Report for PCT/CH2015/000181, dated Mar. 10, 2016.

Written Opinion for international application No. PCT/CH2015/000181, dated Dec. 10, 2015.

Decision to Grant related application RU 2 670 126, dated Aug. 24, 2018.

Decision to Grant related application RU 2667750, dated Aug. 15, 2018.

International Search Report for PCT/CH2015/000030, dated Dec. 14, 2015.

International Search Report for International Application No. PCT/CH2015/000031, dated Dec. 11, 2015.

International Search Report for PCT/CH2015/000032, dated Dec. 4, 2015.

International Search Report for PCT/CH2016/000033, dated Jun. 6, 2016.

* cited by examiner

METHOD AND DEVICE FOR FRAGMENTING AND/OR WEAKENING POURABLE MATERIAL BY MEANS OF HIGH-VOLTAGE DISCHARGE

CROSS-REFERENCE TO RELATED APPLICATIONS

This is the United States national phase of International Patent Application No. PCT/CH2015/000032, filed Feb. 27, 2015, the entire contents of which are hereby incorporated herein by reference.

TECHNICAL FIELD

The invention relates to methods for the fragmenting and/or weakening of pourable material by means of high-voltage discharges as well as to devices for carrying out the methods according to the preamble of the independent patent claims.

BACKGROUND

From the state of the art, it is known to crush the most diverse materials by means of pulsed high-voltage discharges or to weaken them in such a way that they can be crushed more easily in a subsequent mechanical comminution process.

For the fragmenting and/or weakening of pourable material by means of high-voltage discharges, two different process types are in principle known today.

In the case of small material quantities or strict requirements concerning the purity and/or the target grain size of the processed material, the fragmenting and/or weakening of the material takes place in a batch operation in a closed process vessel in which high-voltage punctures through the material are produced.

In the case of large material quantities, the fragmenting and/or weakening of the material is carried out in a continuous process by guiding a material flow of the to-be-crushed material past one or more high-voltage electrodes and with these high-voltage punctures through the material are produced.

Thereby, the problem arises, however, that in a material flow which is too wide with regard to the actual process zone in which the high-voltage punctures take place, not the entire material is processed which impairs the quality of the processed product whereas in a too narrow material flow a part of the high-voltage punctures take place to the lateral delimiting walls of the device guiding the material flow, which reduces the process efficiency and destroys these limiting walls over time. This also reduces the lifetime of the system and there is the risk that the processed material can be contaminated with foreign material.

GENERAL DESCRIPTION

It is therefore an object to provide continuous methods and devices for the fragmenting and/or weakening of pourable material by means of high-voltage discharges which do not have the aforementioned disadvantages of the prior art or at least in part avoid these.

According to these, a first aspect of the invention relates to a method for the fragmenting and/or weakening of pourable material, in particular of rock fragments or crushed rock, by means of high-voltage discharges.

Thereby, a material flow of the pourable to-be-fragmented or weakened material, respectively, is, immersed in a process liquid, guided past a high-voltage electrode assembly with one or more high-voltage electrodes, while by charging of the high-voltage electrodes with high-voltage pulses, high-voltage punctures are produced through the material of the material flow. According to the invention, the zone of the material flow in which the high-voltage punctures through the material are produced is delimited laterally as viewed in a guiding-past direction by substantially unmoved material areas or zones, respectively, of the same material (unmoved material zones).

In this way, the lateral boundaries of the zone of the moving material flow in which the high-voltage punctures take place (process zone) are formed by identical but substantially unmoved material, thus making it possible to waive devices for the lateral delimiting of the actual process zone, and contamination with foreign material is prevented.

Advantageously, thereby, the unmoved material zones are formed from the material fed via the material flow. For this purpose, the unmoved material zones are preferably formed in such a way that the boundary zones of the material flow are piled up at a location downstream of the high-voltage electrode assembly such that unmoved material zones extend laterally along the entire length of the process zone.

Furthermore, it is preferred that the moving material flow and the unmoved material zones are formed in this way that the pourable material is provided in a trough-like or tank-like device, respectively, flooded with process liquid, the bottom of which is formed by a conveyor belt or a conveyor chain in a central zone and is fixed in the boundary zones. In this way, the unmoved material zones can be created in a controlled and low-wear manner.

Any material which is carried away by the material flow from the unmoved material zones is preferably replaced by material from the material flow and/or replaced by separately supplied material. Depending on the structure of the device used for the carrying out of the method, the one or the other variant may be particularly advantageous or also a combination thereof.

A second aspect of the invention relates to a further method for the fragmenting and/or weakening of pourable material, in particular of rock fragments or crushed rock, by means of high-voltage discharges.

Thereby, a material flow from the pourable to-be-fragmented or weakened material, respectively, is, immersed in a process liquid, guided past a high-voltage electrode assembly with one or more high-voltage electrodes, while high-voltage punctures are produced through the material of the material flow by charging of the high-voltage electrodes with high-voltage pulses. According to the invention, the central zone of the material flow is charged with high-voltage punctures while the boundary zones of the material flow remain substantially unaffected by high-voltage punctures. Subsequently, the material of the central zone of the material flow treated with high-voltage punctures is separated from the untreated material of the boundary zones of the material flow downstream of the high-voltage electrode assembly. In this method, the zone of the material flow in which the high-voltage punctures take place (process zone) is laterally limited by material of the material flow which is not treated with high-voltage punctures, from which also here the advantage arises that, on the equipment side, devices for the lateral delimiting of the actual process zone can be forgone and a contamination with foreign material is prevented.

In this case, it is preferred that the untreated material from the boundary zones of the material flow which is separated from the treated material from the central zone of the material flow is fed entirely or partially again into the material flow at a location upstream from the high-voltage electrode assembly, advantageously into the central zone of the material flow. In this way, the proportion of untreated material, i.e. material which is not treated with high-voltage punctures, can be minimized.

In a preferred embodiment of the method according to the second aspect of the invention, an annular-shaped material flow is guided past the high-voltage electrode assembly. Thereby, the material of the boundary zones remains in the material flow downstream of the high-voltage electrode assembly and is passes the high-voltage electrode assembly again during each cycle of the material flow, while the material in the central zone of the material flow is partly or completely removed from the material flow downstream of the high-voltage electrode assembly and is replaced by new material which is then guided past the high-voltage electrode assembly and charged with high-voltage punctures.

In another preferred embodiment of the method according to the second aspect of the invention, an annular-shaped material flow is guided past the high-voltage electrode assembly. Thereby, the material in the central zone of the material flow is removed partly or completely from the material flow downstream of the high-voltage electrode assembly, the material of the boundary zones is subsequently guided into the thereby created gap in the center of the material flow, and then new material is introduced into the material flow in the boundary zones before it is again guided past the high-voltage electrode assembly and charged with high-voltage punctures.

The formation of an annular-shaped material flow has the advantage that the material remaining in the material flow is automatically guided past the high-voltage electrode assembly again, and then, depending on the embodiment of the method, acts as a delimiter of the process zone again or is charged with high-voltage punctures and is fragmented and/or weakened.

In the case of the two previously described preferred embodiments of the method according to the second aspect of the invention, the annular-shaped material flow is preferably formed by providing the material on a carrousel-like device and by rotating this device about a central, substantially vertical axis is guided past the high-voltage electrode assembly. In this way, the annular-shaped material flow can be produced with a relatively low complexity in terms of system technology.

In the methods according to the first and second aspects of the invention, the high-voltage electrode assembly advantageously comprises a matrix of several high-voltage electrodes, which are each charged with high-voltage pulses in the intended operation. As a result, a two-dimensional charging of the guided past material flow with high-voltage punctures can be achieved.

Preferably, thereby, each of the high-voltage electrodes of the matrix has its own high-voltage generator with which it is charged with high-voltage pulses independently of the other high-voltage electrodes. This makes it possible to ensure a uniform and high energy input into the material flow over the entire surface of the matrix, or also to specifically charge individual zones with different amounts of energy.

As a counter-electrode for the high-voltage electrodes of the high-voltage electrode assembly, in accordance with a preferred embodiment of the methods according to the first and the second aspect of the invention, an element delimiting the bottom side of the material flow in the region of the high-voltage-electrode assembly is used, such that high-voltage punctures occur between the respective high-voltage electrode and this element through the material flow by the charging of the high-voltage electrodes with high-voltage pulses. This element is preferably formed by a conveyor belt or a conveyor chain with which the material flow is guided past the high-voltage electrode assembly. In this case, the high-voltage electrodes of the high-voltage electrode assembly are preferably immersed in the material flow. With this variant of the method, the material of the material flow can be impacted particularly intensively, because the high-voltage punctures occur over the entire thickness of the material flow.

In another preferred embodiment of the methods according to the first and the second aspect of the invention, each of the high-voltage electrodes of the high-voltage electrode assembly has one or more of its own counter-electrodes, i.e. exclusively assigned to the respective high-voltage electrode, which is or are arranged laterally besides and/or below this high-voltage electrode, such that high-voltage punctures between the high-voltage electrode and the counter-electrode or counter-electrodes, respectively, through the material flow guided past these are produced by the charging of the specific high-voltage electrode with high-voltage pulses. In this case, the high-voltage electrodes and/or the counter-electrodes are preferably immersed in the material flow.

This results in the advantage that the breakdown voltage is substantially decoupled from the thickness of the material flow, such that also material flows from large pieces of material can readily be processed. A further advantage of this embodiment is that it offers the greatest possible freedom of design with respect to the supporting surface or the conveying device, respectively, for the material flow in the region of the process zone because the bottom surface of the process zone is not required as counter-electrode.

In the last-mentioned preferred embodiment, it is further preferred that the counter-electrodes are supported by the respective high-voltage electrode or by its support structure, respectively.

As stated above, it is possible with the inventive methods to fragment and/or weaken pourable material in a continuous process by means of high-voltage discharges in a low-wear and low-contamination manner.

A third and a fourth aspect of the invention relate to a device for carrying out the method according to the first aspect or the second aspect of the invention, respectively.

The device comprises a high-voltage electrode assembly with one or more high-voltage electrodes, as well as one or several high-voltage generators, by means of which the high-voltage electrode or the high-voltage electrodes of the high-voltage electrode assembly is or are chargeable with high-voltage pulses.

Furthermore, the device comprises an advantageously linearly conveying conveying device, e.g. in the form of a conveyor belt or a conveyor chain, which is arranged in a basin which is filled or fillable with a process liquid, and with which, in the intended operation, a material flow of a pourable, to-be-fragmented and/or weakened material, can be, immersed in the process liquid, guided past the high-voltage electrode assembly, while high-voltage punctures through the material flow are produced as a result of a charging of the high-voltage electrode assembly with high-voltage pulses.

In this case, the device according to the third aspect of the invention is designed in such a way that, in the intended operation during the guiding past of the material flow, in the boundary zones of the region in which the high-voltage punctures through the material of the material flow are produced, the material of the material flow piles up to a substantially unmoved material zone each, which is essentially unaffected by the high-voltage punctures. With an advantage, the device comprises devices for the selective piling up of the material flow, e.g. baffles or lateral delimiting walls for the material flow with recesses in which the material piles up. Due to the fact that the lateral delimiters of the zone of the moving material flow in which the high-voltage punctures take place (process zone) are formed by identical but substantially unmoved material, wear-intensive devices for the lateral delimiting of the actual process zone can be forgone, which has a positive effect on the operating costs and on the maintenance-related standstill times of the device, and also makes possible a process control with low foreign material contamination.

In contrast to the device according to the third aspect of the invention, the device according to the fourth aspect of the invention is structured in such a way that, in the intended operation during the guiding of the material flow past the high-voltage electrode assembly, the central zone of the material flow is charged with high-voltage punctures while the boundary zones of the material flow are essentially unaffected by the high-voltage punctures. In addition, the device comprises a separation device, by means of which in the intended operation the material of the boundary zones of the material flow is separated from the material of the central zone of the material flow downstream of the high-voltage electrode assembly. Advantageously, the device further comprises additional devices for returning the material of the boundary zones of the material flow, which is separated by the separation device, back into the material flow upstream of the high-voltage electrode assembly, such that this material can be again guided past the high-voltage electrode assembly, for the fragmenting and/or weakening of the same or for the renewed formation of the boundary zones of the material flow.

Due to the fact that the lateral delimiters of the zone of the moving material flow, in which the high-voltage punctures take place (process zone), are formed by the material of the moving material flow, wear-intensive devices for the lateral delimiting of the actual process zone can also be forgone here, which as has already been mentioned positively affects the operating costs and the maintenance-related standstill times of the device and also makes possible a process control with low foreign material contamination.

A fifth aspect of the invention relates to a further device for carrying out of the method according to the second aspect of the invention.

This device also comprises a high-voltage electrode assembly with one or more high-voltage electrodes as well as one or more high-voltage generators, by means of which the high-voltage electrode or the high-voltage electrodes of the high-voltage electrode assembly is or are chargeable with high-voltage pulses.

Furthermore, the device comprises a conveying device in the form of a carousel-like device, with which in the intended operation a material flow of a pourable to-be-fragmented and/or weakened material, immersed in a process liquid, can be guided past the high-voltage electrode assembly, while high-voltage punctures through the material flow are produced by charging of the high-voltage electrode assembly with high-voltage pulses.

Furthermore, the device comprises a material removal device, by means of which, in the intended operation, material is removed from the central zone of the material flow downstream of the high-voltage electrode assembly, and a material feeding device, by means of which, in the intended operation, in a region downstream of the material removal device and upstream of the high-voltage electrode assembly, pourable to-be-fragmented and/or weakened material can be fed into the material flow.

Also in this device, because the lateral delimiters of the zone of the moving material flow, in which the high-voltage punctures take place (process zone), are formed by the material of the material flow, wear-intensive devices for the lateral delimiting of the actual process zone can be forgone, with the already mentioned positive effects on the operating costs, the maintenance-related standstill times of the device, and the foreign material contamination of the processed material.

In addition, this device has the advantage that material remaining in the material flow is automatically guided past the high-voltage electrode assembly again, and then, depending on the embodiment of the device, again serves as a delimiter of the process zone or is charged with high-voltage punctures and fragmented or weakened, respectively.

BRIEF DESCRIPTION OF THE DRAWINGS

Further embodiments, advantages, and applications of the invention result from the dependent claims and from the following description with reference to the figures. Thereby show:

DETAILED DESCRIPTION

Figure 1:
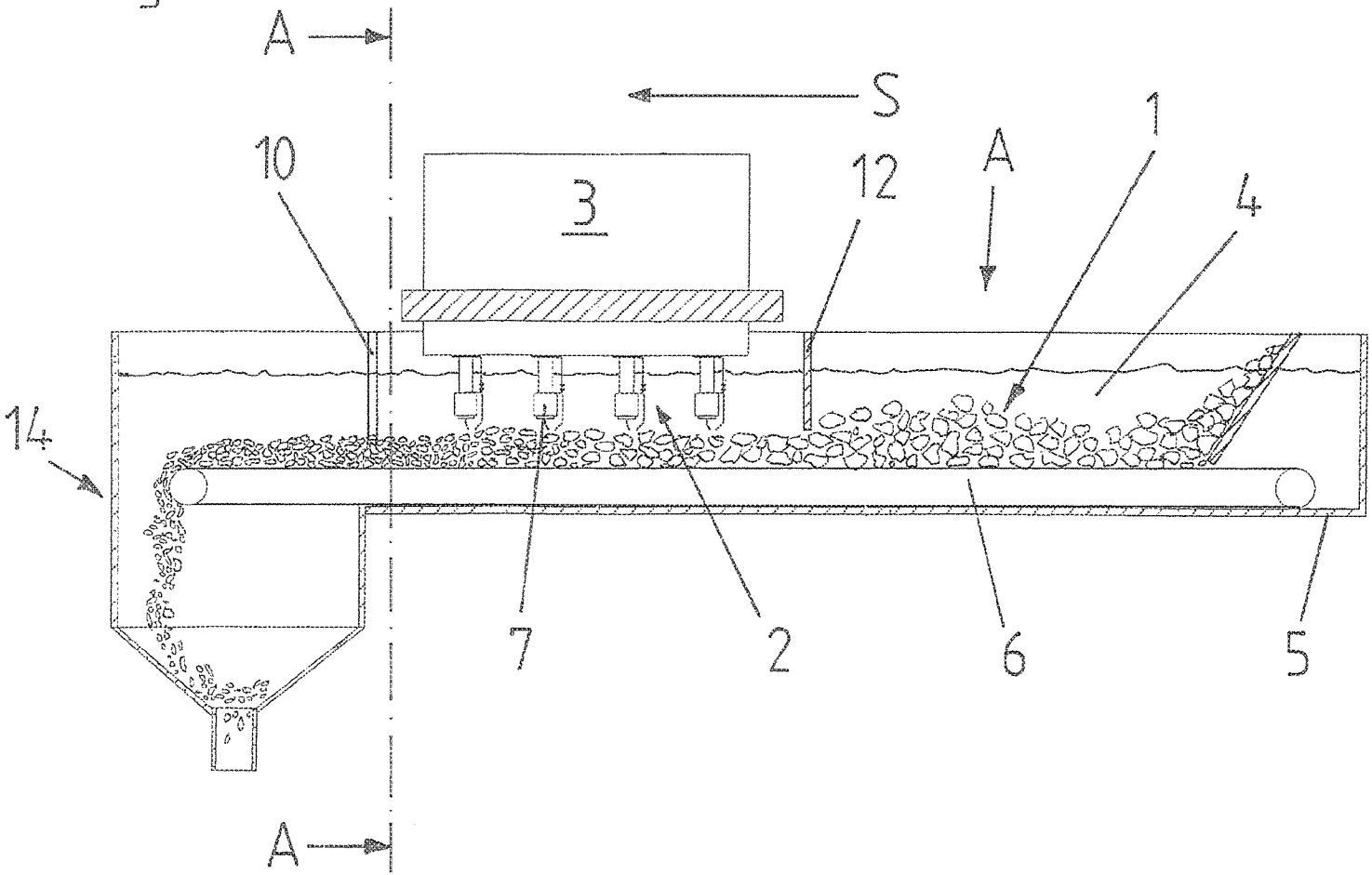
FIG. 1 a longitudinal section along the line B-B in FIG. 3 through a first device according to the invention.
Figure 2:
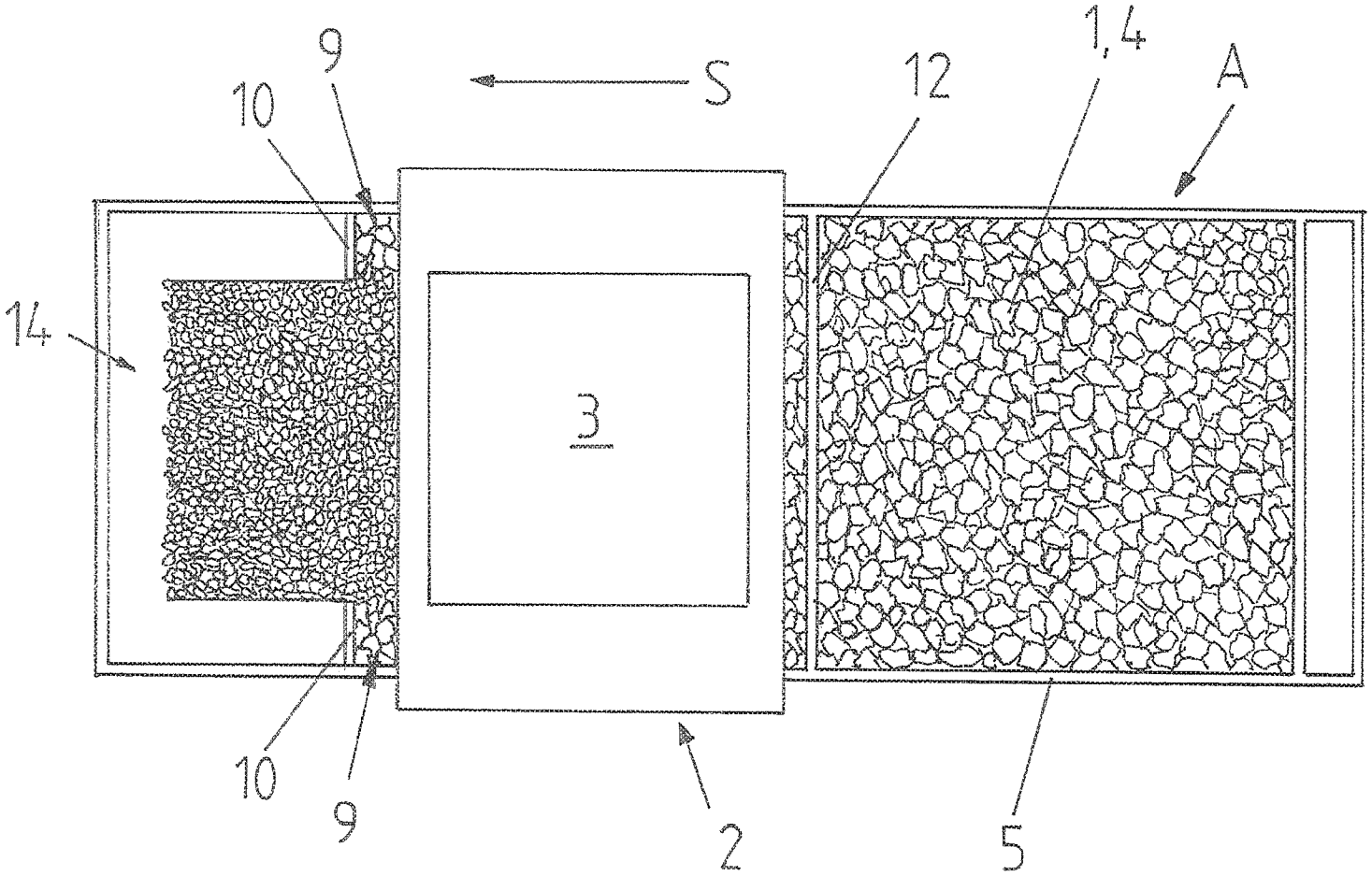
FIG. 2 a top view from above of the device from FIG. 1.
Figure 3:
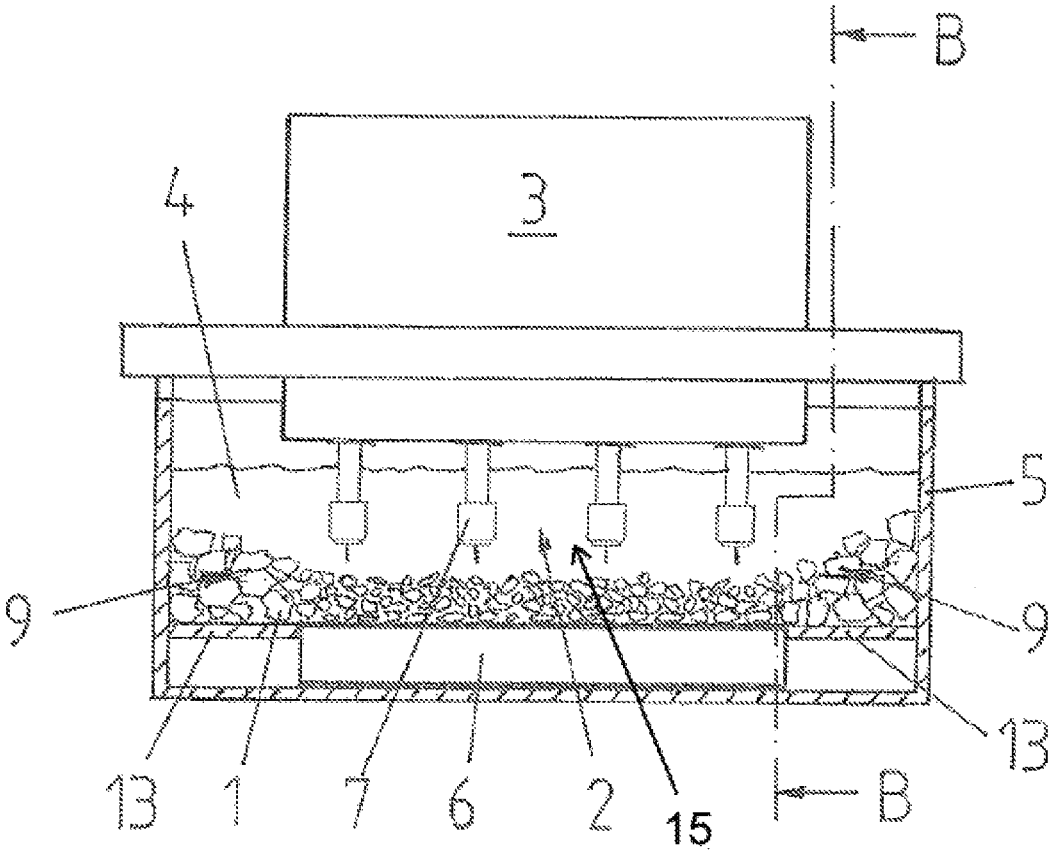
FIG. 3 a cross-section through the device along the line A-A in FIG. 1.

The FIGS. 1 to 3 show a first device according to the invention for the fragmenting of pourable material 1 by means of high-voltage discharges, once in a longitudinal section along the line B-B in FIG. 3 (FIG. 1), once in a top view from above (FIG. 2) and once in a cross-section along the line A-A in FIG. 1 (FIG. 3).

As can be seen, the device comprises a high-voltage electrode assembly 2 with a matrix of 16 high-voltage electrodes 7, which as viewed in the material flow direction S are arranged in four successively arranged rows, each with four high-voltage electrodes 7 (only one of the high-voltage electrodes is provided with the reference numeral 7 in the figures for the sake of clarity).

In the illustrated intended operation, the high-voltage electrodes 7 are each charged with high-voltage pulses by a high-voltage generator 3 arranged directly above them.

A conveyor belt 6 is arranged below the high-voltage electrode assembly 2, arranged in a basin 5 flooded with water 4 (process liquid), with which a material flow of a pourable, to-be-fragmented material 1, in the present case fragments of noble metal ore, is guided from the feeding side A of the device in the material flow direction S past the high-voltage electrodes 7 of the high-voltage electrode assembly 2, while high-voltage punctures through the material 1 are produced by the charging of the high-voltage electrode assembly 2 with high-voltage pulses. Thereby, the material 1 of the material flow is immersed in the water 4 located in the basin 5, as well as the high-voltage electrodes 7 arranged above.

The height of the material flow is adjusted before the inlet into the region between the conveyor belt 6 and the high-voltage electrode assembly 2 (process zone) by a passage-limiting plate 12.

As can be seen from FIG. 3, as viewed in the flow direction S, the conveyor belt 6 does not extend over the entire width of the basin 5, but in the region of the basin center over the width of the process zone 15 in which the high-voltage punctures through the material flow occur. Along the edge regions of the basin 5, supporting sections 13 which are fixedly connected to the side wall of the basin 5 extend at the level of the upper side of the conveyor belt 6, at which ends baffle plates 10 are arranged downstream of the high-voltage electrode assembly 2 which lead to a piling up of the material 1 in the edge regions of the basin 5 on the supporting sections 13 and thereby forms substantially unmoved material zones 9 along these edge regions, which laterally delimit the process zone 15 in which the high-voltage punctures through the material 1 of the material flow are produced.

As can be seen in particular from FIGS. 1 and 3, the material 1 transported on the conveyor belt 6 is increasingly fragmented during the passage through the process zone, while the unmoved material 1 in the edge regions 9 of the basin 5 remains substantially unchanged.

Downstream of the high-voltage electrode assembly 2, the fragmented material 1 emerging from the process zone is discharged from the conveyor belt 6 into a collecting funnel 14 at the end of the basin 5, from where it is conveyed by a conveying device (not shown) out of the basin 5.

Figure 4:
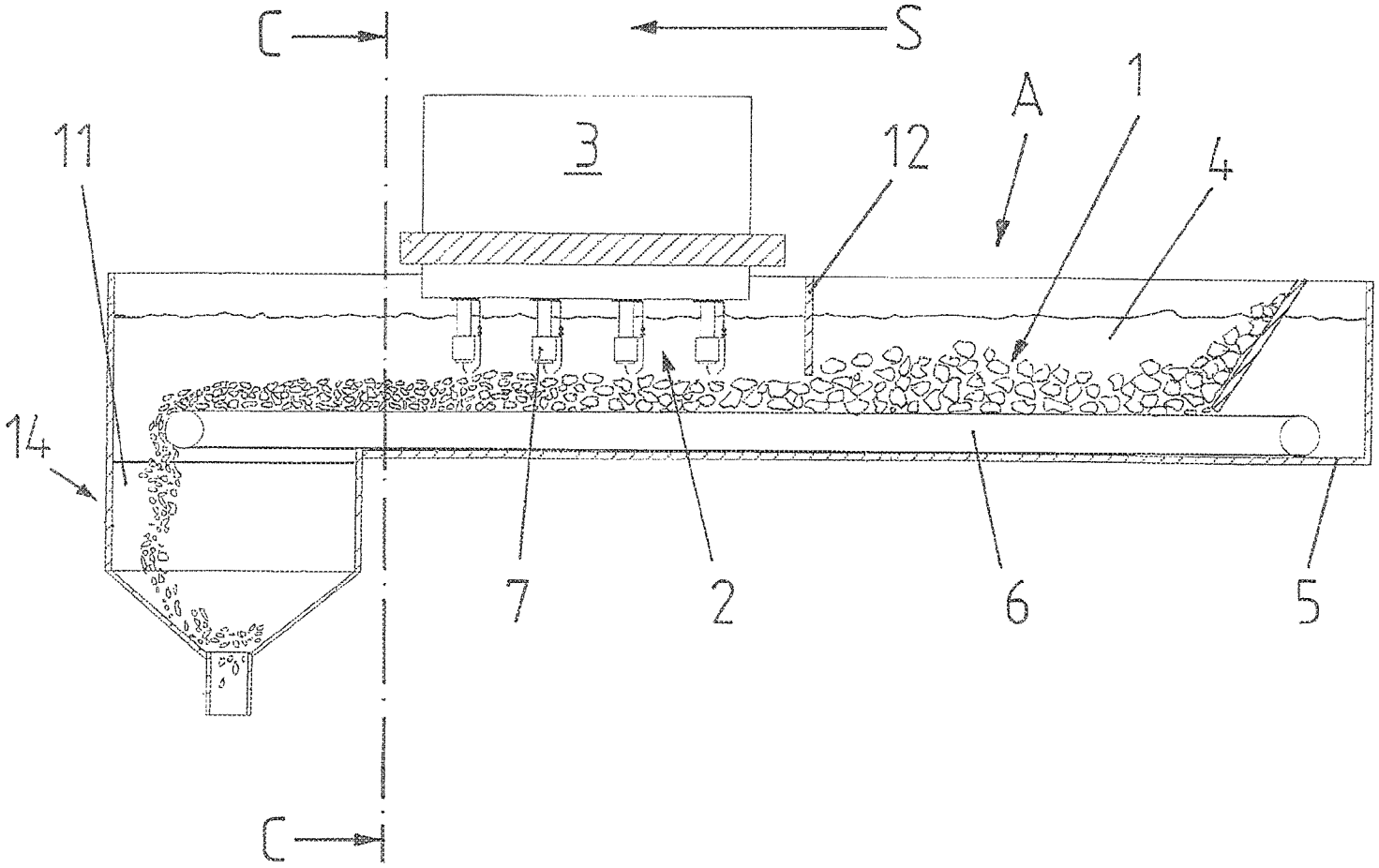
FIG. 4 a longitudinal section along the line D-D in FIG. 6 through a second device according to the invention.
Figure 5:
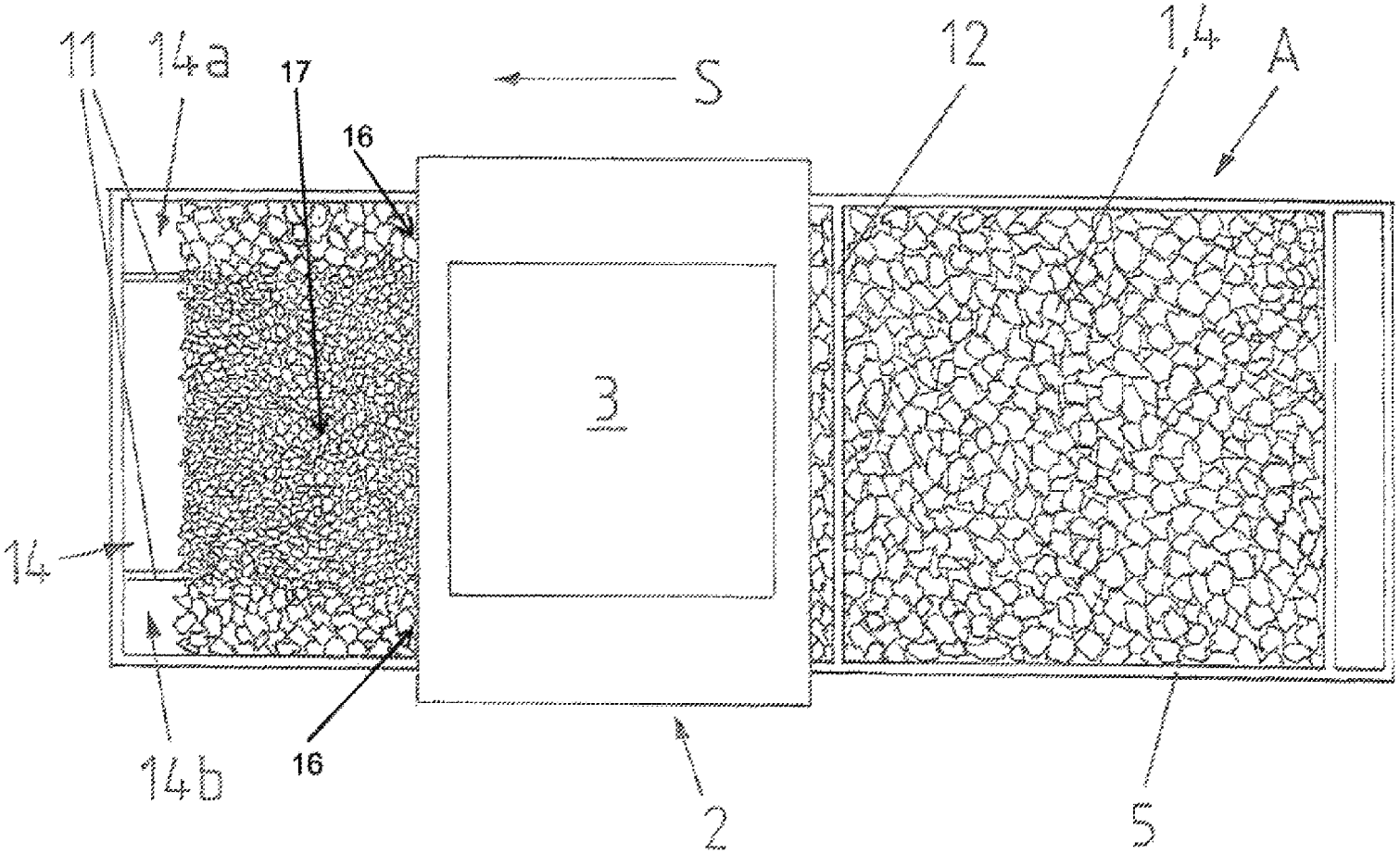
FIG. 5 a top view from above of the device of FIG. 4.
Figure 6:
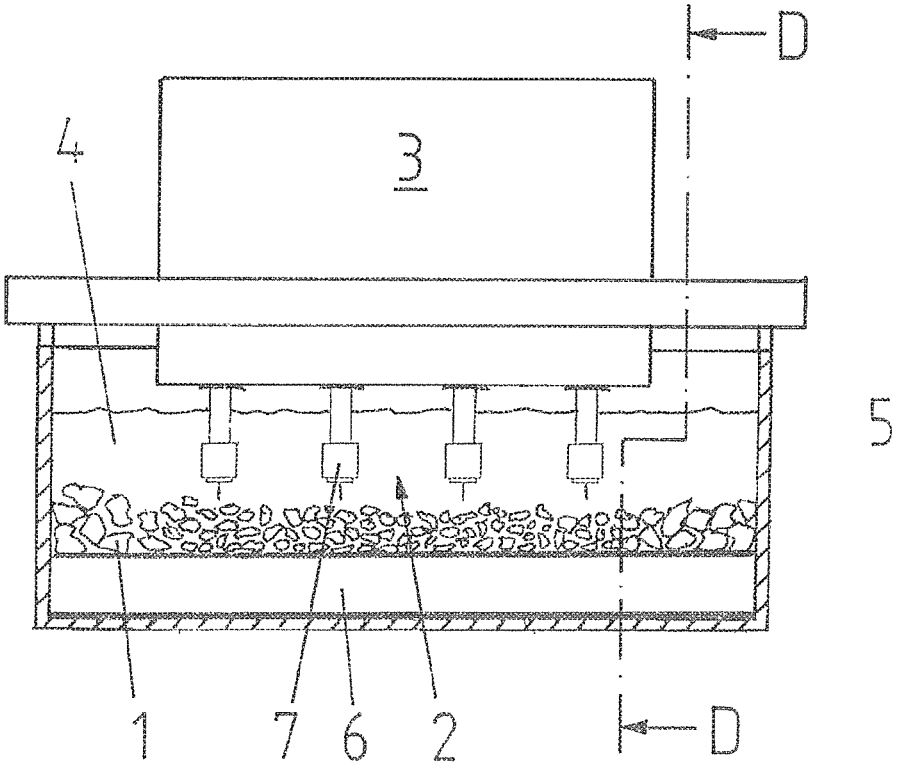
FIG. 6 a cross-sectional view of the device along the line C-C in FIG. 4.

The FIGS. 4 to 6 show a second device according to the invention for fragmenting pourable material 1 by means of high-voltage discharges, once in a longitudinal section along the line D-D in FIG. 6 (FIG. 4), once in a top view from above (FIG. 5) and once in a cross-section along the line C-C in FIG. 4 (FIG. 6).

This device differs from the device shown in FIGS. 1 to 3 in that here the conveyor belt 6 as viewed in a flow direction S extends over the entire width of the basin 5 such that the moving material flow covers the entire width of the basin 5.

As can be seen in particular from FIGS. 4 and 6, the central zone 17 of the material flow is charged with high-voltage punctures during the passage of the process zone, which leads to an increasing fragmenting of the material 1 in this zone, while the boundary zones 16 of the material flow remain virtually unaffected by high-voltage punctures, such that the material 1 guided therein retains its original fragmentation size.

Downstream of the high-voltage electrode assembly 2, the material flow emerging from the process zone is discharged from the conveyor belt 6 into three collecting funnels 14, 14 *a*, 14 *b* at the end of the basin 5, which are separated from each other by separation walls 11 and extend side by side over the entire width of the conveyor belt 6. Thereby, the separation walls 11 are arranged in such a way that the fragmented material 1 from the central zone 17 of the material flow is discharged into the center collecting funnel 14 while the non-fragmented material 1 from the boundary zones 16 of the material flow is discharged into the outer collection funnels 14*a*, 14*b*.

The fragmented material 1, which is discharged into the center collecting funnel 14, is conveyed out of the basin 5 by means of a conveying device (not shown) and fed to another use. The non-fragmented material 1, which is discharged into the outer collection funnels 14*a*, 14*b*, is conveyed out of the basin 5 by means of conveying devices (not shown) and fed into the material flow again on the feeding side A of the device.

Figure 7:
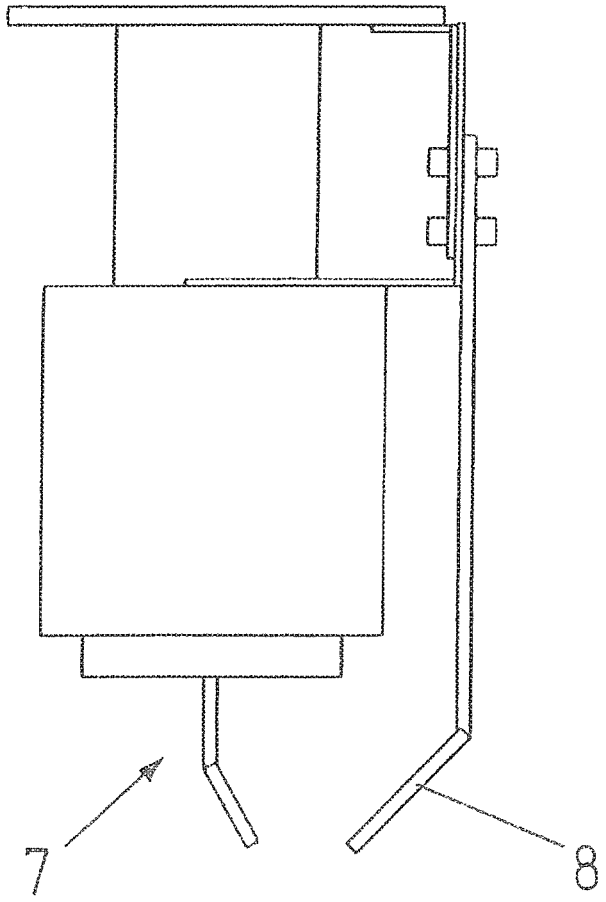
FIG. 7 a side view of one of the high-voltage electrodes of the devices.

As can be seen from FIG. 7 which shows one of the high-voltage electrodes 7 of the high-voltage electrode assemblies 2 of the devices in the side view, each of the high-voltage electrodes 7 comprises a corresponding counter-electrode 8 lying on ground potential, which is laterally arranged besides the respective high-voltage electrode 7 in such a way that in the illustrated operation, by the charging of the specific high-voltage electrode 7 with high-voltage pulses, high-voltage punctures between the high-voltage electrode 7 and the corresponding counter-electrode 8 are produced through the material 1 of the material flow. Thereby, the counter-electrode 8 is attached to the supporting structure of the high-voltage electrode 7.

Figure 8:
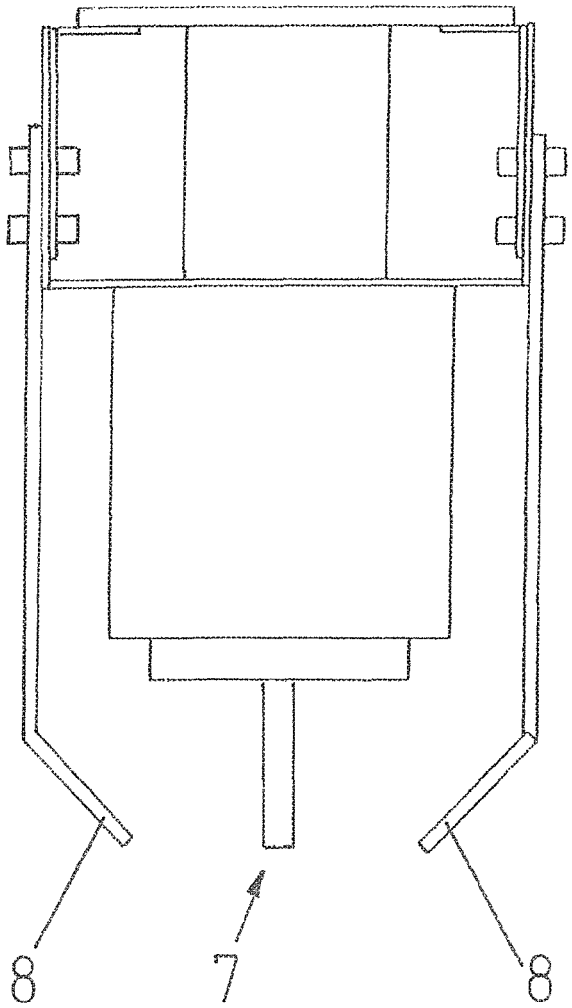
FIG. 8 a side view of a first variant of the high-voltage electrode from FIG. 7.
Figure 9:
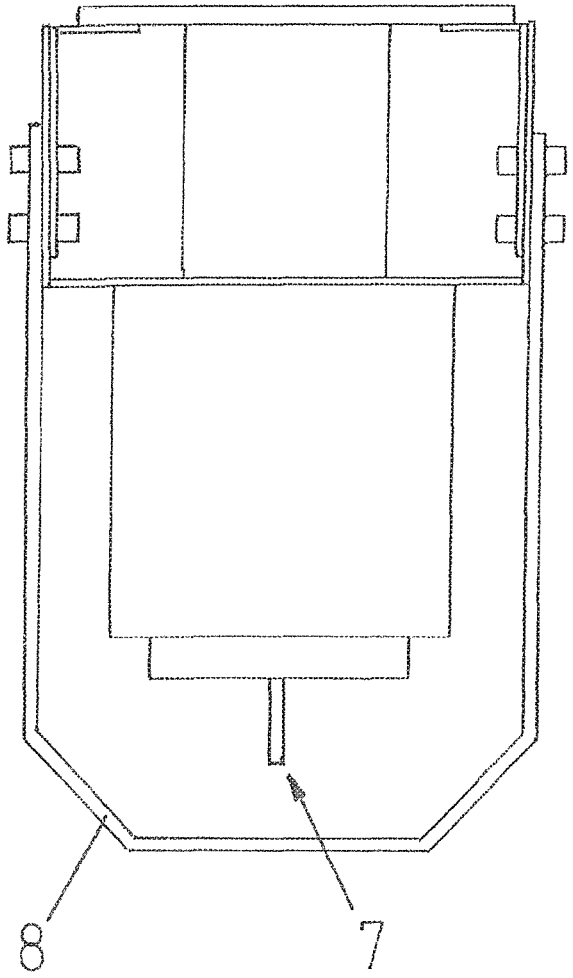
FIG. 9 a side view of a second variant of the high-voltage electrode from FIG. 7.

The FIGS. 8 and 9 show side views of two variants of the high-voltage electrode from FIG. 7.

FIG. 8 shows a high-voltage electrode 7 which differs from the one shown in FIG. 7 essentially in that it comprises two identical counter-electrodes 8 which are mirror-inverted facing. A further difference is that this high-voltage electrode 7 has a straight electrode tip.

FIG. 9 shows a high-voltage electrode 7 which differs from the one shown in FIG. 8 essentially therein that here shown in FIG. 8 the two mirror-inverted facing counter electrodes 8 are connected to a single, U-shaped counter-electrode 8 below the high-voltage electrode 7.

In the intended operation, the high-voltage electrodes 7 and the counter-electrodes 8 are preferably immersed in the material flow.

While there are described preferred embodiments of the invention in the present application, it is to be clearly pointed out that the invention is not limited thereto and can also be carried out in another manner within the scope of the following claims.

The invention claimed is:

1. A method for fragmenting and/or weakening of material by high-voltage discharges, comprising:

a) providing a high-voltage electrode assembly assigned to a high-voltage generator configured to charge the high-voltage electrode assembly with high-voltage pulses;

b) guiding a material flow of material, immersed in a process liquid, past the high-voltage electrode assembly; and c) producing high-voltage discharges through the material flow during the guiding of the material flow past the high-voltage electrode assembly, the high-voltage discharges through the material flow produced by charging the high-voltage electrode assembly with high-voltage pulses, wherein a zone of the material flow in which the high-voltage discharges through the material of the material flow are produced is laterally delimited in a material flow direction by unmoved zones of the material.

2. The method according to claim 1, wherein the unmoved zones are produced by the material in boundary zones of the material flow piling up downstream of the high-voltage electrode assembly.

3. The method according to claim 1, wherein the material flow and the unmoved zones are produced by the material provided in a trough or tank, a bottom of the trough or a bottom of the tank being formed in a central zone by a conveyor belt or a conveyor chain and being fixed in boundary zones of the material flow.

4. The method according to claim 1, wherein material which is carried away by the material flow from the unmoved zones is replaced by material from the material flow.

5. The method according to claim 1, wherein material which is carried away by the material flow from the unmoved zones is replaced by separately supplied material.

6. The method according to claim 1, wherein the high-voltage electrode assembly comprises a matrix of several high-voltage electrodes, each of which are charged with high-voltage pulses.

7. The method according to claim 6, the high-voltage generator being one of one or more high-voltage generators, wherein a respective one of the one or more high-voltage generators is assigned to each high-voltage electrode of the matrix of several high-voltage electrodes, and each high-voltage electrode is charged with high-voltage pulses by the respective one of the one or more high-voltage generators independently of the other high-voltage electrodes.

8. The method according to claim 6, wherein a conveyor belt or a conveyor chain is used as a counter-electrode for the high-voltage electrodes of the high-voltage electrode assembly, the conveyor belt or the conveyor chain delimiting a bottom side of the material flow in the region of the high-voltage electrode assembly, the conveyor belt or the conveyor chain guiding the material flow past the high-voltage electrode assembly.

9. The method according to claim 6, wherein at least one specific counter-electrode is arranged laterally beside and/or below each of the high-voltage electrodes of the high-voltage electrode assembly in such a way that by charging a respective high-voltage electrode with high-voltage pulses, the high-voltage discharges through the material flow are produced between the respective high-voltage electrode and the specific counter-electrode arranged laterally beside and/or below the respective high-voltage electrode.

* * * * *